United States Patent [19]

Ballantyne

[11] Patent Number: 4,862,821

[45] Date of Patent: Sep. 5, 1989

[54] MECHANISM FOR TENSIONING A MOVING CHAIN

[75] Inventor: Ronald Ballantyne, Burlington, Canada

[73] Assignee: John T. Hepburn, Limited, Mississauga, Canada

[21] Appl. No.: 192,763

[22] Filed: May 10, 1988

[30] Foreign Application Priority Data

May 12, 1987 [CA] Canada ..... 536953

[51] Int. Cl.[4] ..... B63B 21/24

[52] U.S. Cl. ..... 114/293; 114/200; 254/372; 188/65.1

[58] Field of Search ..... 114/199, 213, 216, 217, 114/200, 293; 188/65.1, 65.2, 65.3; 254/334, 358, 372; 59/78.1, 93

[56] References Cited

U.S. PATENT DOCUMENTS

| | | | |
|---|---|---|---|
| 3,540,396 | 11/1970 | Horton | 114/293 |
| 3,547,066 | 12/1970 | Bugaenko | 114/200 |
| 4,476,801 | 10/1984 | Foster et al. | 114/293 |

FOREIGN PATENT DOCUMENTS

| | | |
|---|---|---|
| 863283 | 3/1961 | United Kingdom . |
| 938268 | 10/1963 | United Kingdom . |
| 978929 | 1/1965 | United Kingdom . |
| 978930 | 1/1965 | United Kingdom . |
| 1211891 | 11/1970 | United Kingdom . |

*Primary Examiner*—Joseph F. Peters, Jr.

*Assistant Examiner*—Jesus D. Sotelo

*Attorney, Agent, or Firm*—Sim & McBurney

[57] ABSTRACT

In an anchoring system for a floating vessel which includes an anchor line comprising chain cable, a chain locker and a windlass having a chain wheel that conveys the chain cable during paying out from the chain locker, a mechanism is positioned between the chain locker and chain wheel to back-tension the chain during paying out. The mechanism has an axis along which the chain is passed with every second links oriented in a given plane. Paired brake shoes are positioned to either side of the plane and define braking surfaces of sufficient extent along the axis of chain movement that a given chain link and an immediately succeeding link of similar orientation can be simultaneously engaged during their movement to provide a continuous retarding effect. One pair of braking shoes is pivotally mounted on an appropriate support structure and urged with hydraulic cylinders towards the other pair thereby causing the brake shoes to engage the opposing faces chain link. The pressure of hydraulic fluid applied to the cylinders is adjusted to back-tension the chain sufficiently that sudden shocks to the windlass otherwise occasioned by tilting and jumping of chain links during conveyance over the chain wheel are avoided. Nonstandard links and irregularities in the chain link surfaces such as weld lines are accommodated by contraction of the hydraulic cylinders and deflection of the pivoting brake shoes.

5 Claims, 3 Drawing Sheets

MECHANISM FOR TENSIONING A MOVING CHAIN

FIELD OF THE INVENTION

The invention relates generally to the anchoring of drill platforms and other large floating vessels, and more particularly, to controlling the paying out of chain cables commonly used in anchoring such vessels.

DESCRIPTION OF THE PRIOR ART

Drill platforms are commonly anchored to the sea floor by means of a composite anchor line consisting of a lower length of chain cable connected to an upper length of wire rope. It is known that such composite anchor lines display better anchoring characteristics at certain water depths than can otherwise be achieved through use of wire rope or chain cable alone. In a variety of prior anchoring systems adapted to handle such composite anchor lines, it has been common to run the line over a chain wheel having conventional whelps suitable for handling the chain cable and also provided with a central wire rope groove appropriate for conveying wire rope.

It has recently been noted by the inventor that problems can occur during paying out of the chain cable, particularly at a stage when substantially all chain cable has been paid just prior to making a transition to operation on wire rope. In such circumstances there is very high tension in the outboard anchor line created by the substantial length of chain cable already paid out. On the other hand, there is very little tension on the remaining inboard chain line. This may periodically cause individual chain links to tip upwardly during transition over the chain wheel and may cause the chain wheel, associated windlass and surrounding deck structure to be suddenly shocked as the slack effectively created by such tipping of individual links is suddenly eliminated with further passage of the affected link over the chain wheel.

Although this problems has been described in connection with the paying out of a composite anchor line, similar problems may be expected when mooring on chain alone if substantially all chain has been paid out from a chain locker, or if the chain locker is not deep enough to allow an adequate length of chain to be suspended behind the associated chain wheel to provide sufficient back tension realtive to the anchor line tension, or if some short pitch chain is present in the line which initiates jumping of the chain.

SUMMARY OF THE INVENTION

It is an object of the present invention to provide a mechanism which can be used inter alia to control the paying out of chain cable in anchoring systems over a chain wheel.

In one aspect, the invention provides a mechanism for backtensioning a chain which may be in the process of being paid out over a chain wheel associated with an anchoring system. The mechanism includes a support structure with an axis along which the chain travels with a first set of chain links oriented in a first plane containing the axis and a second set of chain links (the links alternating with the first set of chain links) oriented in a second plane containing the same axis and substantially perpendicular to the first plane. A pair of brake structures are positioned on opposing sides of the axis and at least one of the brake structures is mounted for movement towards and away from the other. Each of the brake structures preferably has braking surfaces of sufficient extent along the axis of chain movement that the braking structures can be engaged with opposing surfaces of a particular link and engaged with corresponding surfaces of an immediately succeeding link in the first set of chain links before contact is lost with the particular link, thereby ensuring that back tension is continuously applied to the chain despite the intervening links of the second chain link set. Biasing means preferably in the form of one or more fluid-powered cylinders urge the brake structures towards one another such that the brake structures engage opposing surfaces of each link of the first set during its passage through the mechanism, but permit relative separation of the associated braking surfaces in response to non-standard links and irregularities in chain link surfaces such as weld joints.

Various features which can be associated with such mechanisms are described in greater detail below in connection with a preferred embodiment and various inventive aspects of such mechanisms will be identified in the appended claims.

DESCRIPTION OF THE DRAWINGS

The invention will be better understood with reference to drawings illustrating a preferred embodiment, in which.

DESCRIPTION OF PREFERRED EMBODIMENT

Figure 2:
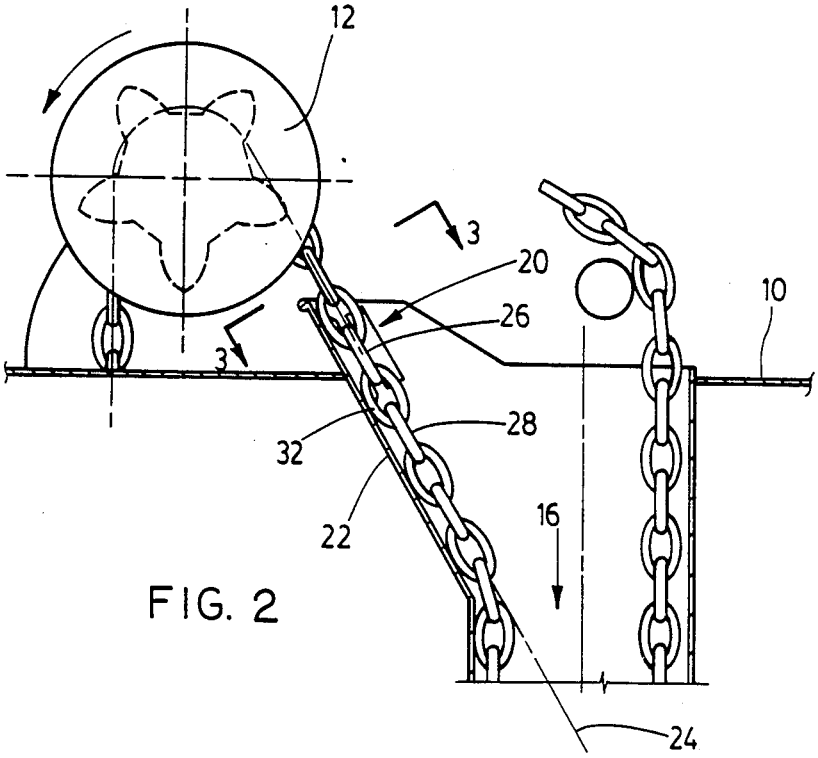
FIG. 2 is a diagrammatic cross-sectional view in a vertical plane of a mooring system of which the chain wheel of FIG. 1 is a component and which incorporates a chain tensioning mechanism according to the invention.

Reference is made to FIG. 2 which illustrates components of an anchoring system mounted on a drill platform 10. These components include a chain wheel 12 over which a chain cable 14 constituting part of an anchoring line is conveyed, and a chain locker 16 formed in the drill platform 10 which stores the chain cable 14. The chain wheel 12 is associated with a conventional windlass (not illustrated) which serves to haul in and pay out the chain cable 14 from the chain locker 16.

Figure 1:
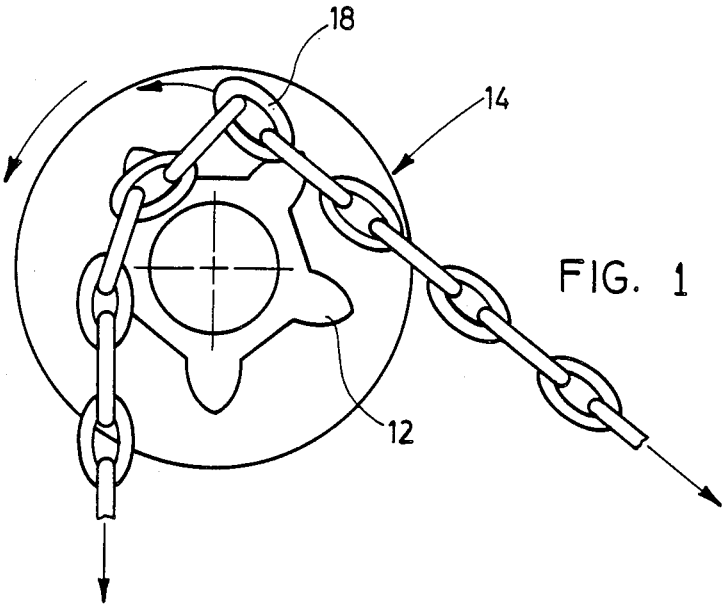
FIG. 1 is a cross-sectional view in the general plane of a chain wheel diagrammatically illustrating the problem of chain link tipping during paying out of chain cable portions of an anchor line.

The particular problem addressed by the invention in this context is diagrammatically illustrated in FIG. 1 where only the chain wheel 12 and a portion of the chain cable 14 being conveyed over the chain wheel 12 are illustrated. It should be assumed that a considerable length of the chain cable 14 hangs vertically from the chain wheel 12 and has been carried away from the drill platform 10 by an appropriate vessel in preparation for anchoring and that only a comparatively short length of the chain cable 14 remains on the inboard side of the chain wheel 12 in the chain locker 16. Since the chain links in such applications may weigh in the order of about 200 pounds, there is considerable tension in the outboard chain line, but there may be comparatively little backtension provided by the remaining inboard chain. In such circumstances, a link such as the link 18 may occasionally tip onto one end during transition over the chain wheel 12, in effect creating a measure of slack in the chain line. Once the chain links outboard of the particular link 18 begin to complete their transition over the chain wheel 12, the slack is suddenly released and because of the high load on the outboard chain line, the chain wheel 12, the associated windlass and surrounding deck structure are suddenly shocked. As mentioned above, this problem may be particularly acute in an anchoring system comprising wire rope and chain cable where substantially all chain cable is paid out just prior to making a transition to operation on wire rope. A variety of such systems are known, and reference may be made to U.S. Pat. No. 4,476,801 to Foster et al to obtain a general understanding of such systems.

To alleviate the problem, a back-tensioning mechanism 20 is mounted to the drill platform 10 between the chain locker 16 and the chain wheel 12. This mechanism 20 can be actuated to apply a retarding force as chain links are conveyed to the chain wheel 12 thereby avoiding the tipping problem which has been described.

This particular back-tensioning mechanism 20 is mounted to an existing chain pipe coaming which forms a support structure 22 extending from the upper end of the chain locker 16. The support structure 22 has the generally U-shaped cross-sectional configuration apparent in FIG. 3. Chain links pass through the structure 22 along an axis 24 with a first set of links (links 26,28 being typical of this set) oriented in a first plane 30 containing the axis 24 and a second set of links (the link 32 joining the links 26,28 being typical of this second set) oriented in a second plane 34 containing the axis 24 and perpendicular to the first plane 30.

Figure 3:
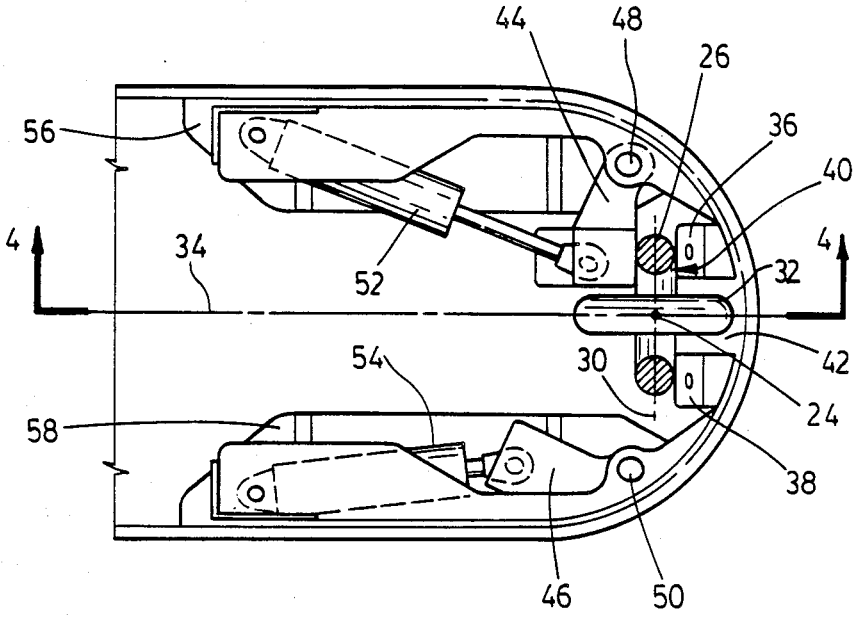
FIG. 3 is a view along the lines 3—3 of FIG. 1 through the tensioning mechanism; and, FIG. 4 is a view along the lines 4—4 of FIG. 3.

The chain tensioning mechanism 20 has a stationary brake structure fixed to the support structure 22 and positioned to one side of the first plane 30. In FIG. 3, it will be noted that this brake structure comprises a pair of brake shoes 36, 38 positioned one to either side of the second plane 34 so as to contact spaced-apart surface portions of one face 40 of the chain link 26. As apparent in FIG. 4, the two brake shoes 36, 38 have braking surfaces with sufficient extent along the axis 24 of the movement of the chain that they can simultaneously engage not only the face 40 associated with the link 26 but also the corresponding face of the immediately succeeding link 28 during the transition of these links through support structure 22. The alternating link 32 positioned between the links 26, 28 simply passes in a clearance space 42 between the two brake shoes 36, 38.

Figure 4:
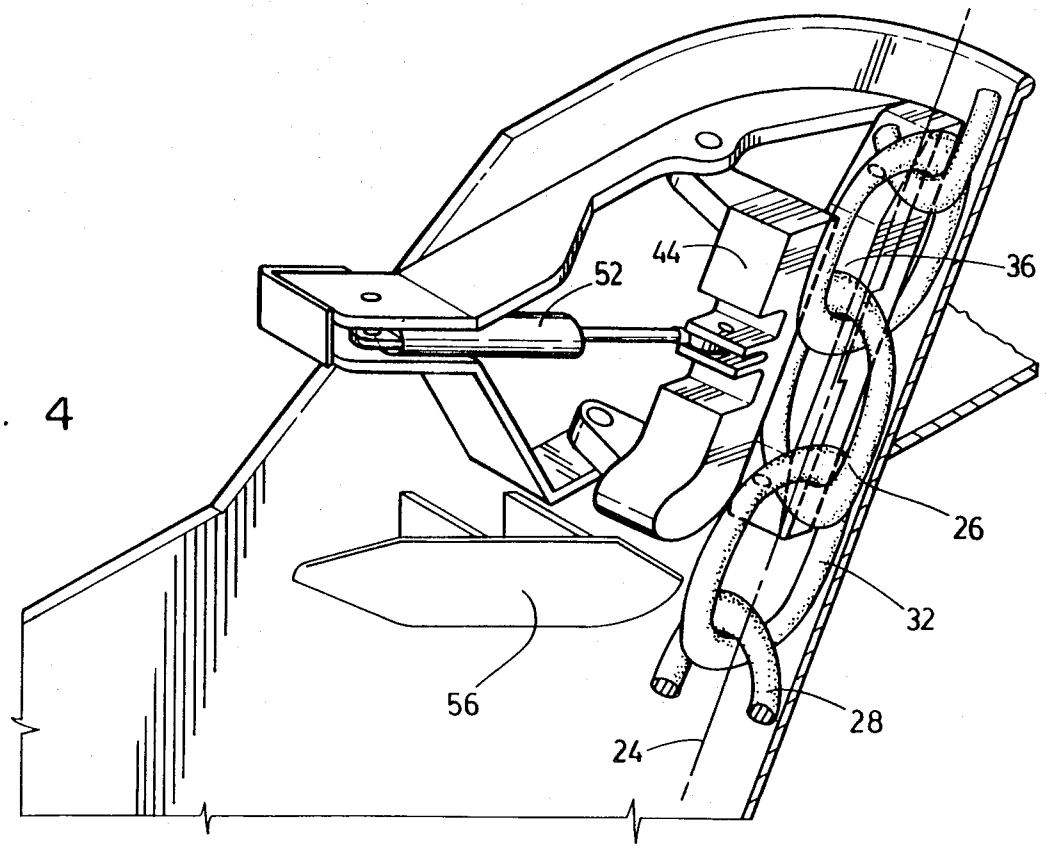

Another brake structure is defind on an opposing side of the first plane 30 and the axis 24 of chain movement. This brake structure comprises two brake shoes 44, 46 mounted on axles 48, 50 which permit pivoting movement of the movable brake shoes 44, 46 towards and away from the stationary brake shoes 36, 38. A pair of hydraulic cylinders 52, 54 each pivotally mounted at one end thereof to the support structure 22 and at the rod end thereof to the movable brake shoes 44, 46 can be selectively actuated to advance and retract the movable brake shoes 44, 46 relative to the stationary brake shoes 36, 38. In FIG. 3, one movable brake shoe is shown in an advanced position by the hydraulic cylinder 52 such that the opposing faces of the link 26 are slidably gripped between the braking surfaces associated with the stationary brake shoe and the movable brake shoe. In FIG. 4, the other movable brake shoe has been shown in a retracted position. In normal operation, however, the two movable brake shoes 44, 46 would be urged simultaneously by the biasing cylinders 52, 54 towards the stationary brake shoes 36, 38 to engage the opposing faces of the links 26, 28 or would be simultaneously retracted.

It should be noted that the edges of the various brake shoes are rounded to prevent possible jamming with incoming chain links. Also, the various brake shoes are flaired outwardly relative to the axis 24 of chain movement, at what constitutes the chain inlet of the support structure 22 during paying out, to ensure proper receipt of the alternating links oriented in the second plane 34 between the two brake shoes 36, 38 and smooth engagement with each link of the first set during movement through the support structure 22.

Angled deflector plates 56, 58 are welded to the interior surfaces of the support structure 22 on opposing sides of the axis 24 of chain movement and the second plane 34 referred to above. These plates 56, 58 flare outwardly relative to the axis 24, their separation increasing along the axis 24 of chain movement in a direction opposite to that required for paying out. These deflector plates 56, 58 are provided to protect the chain tensioning mechanism 20 against possible swinging of the chain cable 14 during dynamic paying out. This function is not critical during hauling in of the chain cable 14 as the movable brake shoes 44, 46 can be conveniently retracted in such circumstances to avoid any interference with the process of hauling in the chain cable 14.

The chain tensioning mechanism 20 is actuated during paying out to engage the stationary and movable brake shoes with the opposing faces of the chain links passing through the mechanism 20. In a typical application, in which the outboard chain cable might be subject to tension int he order of 100 tons when almost fully paid out, the hydraulic cylinders 52, 54 associated with the mechanism 20 might be sized to produce compressive forces in the order of 14,000 pounds. Assuming a coefficient of friction which might for example be in the order of 0.3 between the cast iron constituting the braking surfaces of the various brake shoes and typical studlink chains, and given the reaction of braking forces into opposing faces of each of the chain links, a maximum backtension in the order of about 7.5 tons might potentially be generated. This is higher than actually required for the purposes of reducing chain link tipping, and accordingly pressure reducing valves may be associated with the hydraulic controls powering the hydraulic cylinders 52, 54 to reduce back-tension to about 2–3 tons. This measure of back-tension would normally be sufficient to overcome the tipping problem. It should be noted that these various values are intended only to give a general indication of the necessary sizing of the components of such a mechanism 20 and their operation. In practice, it would be necessary to consider the exact nature of the anchoring system involved.

The importance of the biasing arrangement should be noted. With the hydraulic cylinders 52, 54 actutaed to provide about 2–3 tons of retarding force, the cylinders 52, 54 can contract and the movable brake shoes 44, 46 can consequently deflect in response to weld joints, irregular links and the like, as these are dragged between the various brake structures under the high tension in the outboard chain line. Alternative biasing means may be used, such as pneumatic devices, and it would also be possible to provide a spring-biased mechanism, although the fluid-powered devices are strongly preferred.

In the embodiment illustrated, the brake structures engage opposing faces of the chain links conveyed through the chain tensioning mechanism 20. It would also be within the ambit of the present invention to apply braking forces to the outer longitudinal side surfaces of the links joning the two faces of each link, the side surfaces which are oriented substantially parallel to the axis 24 of chain movement. This might be done with brake shoes formed with an appropriate longitudinal channel defining braking surfaces which conforms roughly to these side surface. Regardless of the mechanism implemented, it is desirable to apply the braking forces to "opposing" surfaces of a chain link, surfaces so positioned that braking forces are effectively reacted entirely into the chain links.

It will be appreciated that a particular embodiment of the invention has been described to exemplify the principles associated with the invention and that modifications may be made therein without departing from the spirit of the invention or the scope of the appended claims.

I claim:

1. An anchoring system for a floating vessel, comprising:

an anchor line including chain cable;

a chain locker for storing the chain cable;

a chain wheel over which the chain cable is paid out from the chain locker; and, a mechanism positioned in the path of movement of the chain cable from the chain locker to the chain wheel for back-tensioning the chain cable during paying out, the mechanism including (a) a support structure which has an axis along which the chain can move with a first set of chain links oriented in a first place containing the axis and a second set of chain links alternating with the first set of chain link oriented in a second plane containing the same axis and substantially perpendicular to the first plane, (b) a first brake structure positioned to one side of the axis, (c) a second brake structure positioned to an opposite side of the axis, (c) mounting means mounting the first and second brake structures to the support structure for relative movement towards and away from one another, and (d) biasing means mounted on the support structure for urging the first and second brake structures towards one another such that the brake structures successively engage each chain link of the first set as the chain cable moves along the axis, the brake structures contacting opposing surfaces of the engaged chain link.

2. An anchoring system as claimed in claim 1 in which the first and second brake structures are adapted to engage opposing surfaces of a chain link of the first set immediately succeeding the engaged chain link before disengaging from the engaged chain link.

3. A mechanism as claimed in claim 2 in which the biasing means comprise a fluid-powered cylinder acting between the support structure and a movable one of the first and second brake structures.

4. A mechanism as claimed in claim 1 which:

the first brake structure comprises a first pair of brake shoes, one of the first pair of brake shoes being positioned to one side of the second plane and the other of the brake shoes being positioned to the other side of the second plane;

the second brake structure comprises a second pair of brake shoes, one of the second pair of brake shoes being positioned to one side of the second plane and mounted for movement towards and away from the one of the first pair of brake shoes, the other of the second pair of brake shoes being positioned to the other side of the second plane and mounted for movement towards and away from the other of the first pair of brake shoes;

the first and second pairs of brake shoes being positioned for engagement with opposing faces of each chain link of the first set during its movement along the axis;

the biasing means comprise a first fluid-powered cylinder acting between the support structure and the one of the second pair of brake shoes and a second fluid-powered cylinder acting between the support structure and the one of the second pair of brake shoes.

5. An anchoring system as claimed in claim 4 in which each of the first and second pairs of brake shoes has a braking surface having sufficient extent in the direction of the axis that each brake shoe engages opposing surfaces of a chain link of the first set immediately succeeding the engaged chain link before disengaging from the engaged chain link.

* * * * *